US006390790B1

(12) United States Patent
Robertson et al.

(10) Patent No.: US 6,390,790 B1
(45) Date of Patent: May 21, 2002

(54) VACUUM PUMP WITH MOTOR COOLING

(75) Inventors: Tobin A. Robertson, Monroe; Lawrence L. Welch, III, West Monroe, both of LA (US)

(73) Assignee: Thomas Industries, Sheboygan, WI (US)

( * ) Notice: Subject to any disclaimer, the term of this patent is extended or adjusted under 35 U.S.C. 154(b) by 76 days.

(21) Appl. No.: 09/135,390

(22) Filed: Aug. 17, 1998

(51) Int. Cl.[7] ..... F04B 17/00; F04B 35/00

(52) U.S. Cl. ..... 417/413.1; 417/366

(58) Field of Search ..... 417/366, 413.1

(56) References Cited

U.S. PATENT DOCUMENTS 5,222,878 A * 6/1993 Osada et al. ..... 417/417

* cited by examiner

*Primary Examiner*—Timothy S. Thorpe
*Assistant Examiner*—Timothy P. Solak
(74) *Attorney, Agent, or Firm*—Quarles & Brady LLP

(57) ABSTRACT

A vacuum pump has a housing enclosing a pump mechanism. The pump mechanism has an electrical motor enclosed in a motor chamber. Air pumped by the pump mechanism is exhausted into the enclosed motor chamber to cool the motor and then exhausted out of the motor chamber and pump housing. The relatively higher density air passing through the motor chamber and housing improves convective cooling of the pump motor.

5 Claims, 3 Drawing Sheets

VACUUM PUMP WITH MOTOR COOLING

CROSS REFERENCES TO RELATED APPLICATIONS

Not Applicable

STATEMENT REGARDING FEDERALLY SPONSORED RESEARCH

Not Applicable

FIELD OF THE INVENTION

The field of invention is vacuum pumps, and more particularly a method and apparatus for cooling the motor in a vacuum pump.

BACKGROUND OF THE INVENTION

Vacuum pumps are used in many applications, for example, where a quiet, reliable vacuum is required. In many applications, the pump is a component of a larger system, so reliability of the pump is important to make the system reliable.

A prior art vacuum linear pump is Linear pump Model No. LP-200H supplied by Yasunaga Corporation, Tokyo, Japan, which is illustrated in FIGS. 1 and 2. This pump includes a vacuum pump mechanism 12 enclosed within a housing 14 that is mounted on a plenum base 16. Ducts 18 communicatively connect the pump mechanism 12 to the plenum base 16.

The housing 14, having an opening 15, encloses the pump mechanism 12 and is mounted to the plenum base 16 with screws. A gasket (not shown) interposed between the housing 14 and base 16 is required to maintain an air tight seal. The threaded opening 15 formed in the housing wall 17 is connected by a hose or pipe to supply a subatmospheric where it is desired.

The base 16 is a plenum having a port 20, a pair of passageways 22, and support legs 24. The plenum passageways 22 have upwardly extending cylindrical extensions 23 that receive the downwardly extending cylindrical ducts 18 communicatively connecting the plenum base 16 to the vacuum pump mechanism 12, forming a substantially airtight connection.

Referring to FIGS. 1 and 2, the vacuum pump mechanism 12 has two pump assemblies 26 mounted on opposing sidewalls 28 of a hollow motor chamber 30. Each pump assembly 26 has a first chamber 32, a compression chamber 34 adjacent to the first chamber 32, and a second chamber 36 adjacent to the compression chamber 34 and disposed above and separated from the first chamber 32.

The motor chamber 30 having sidewalls 42, a top wall 50 and a bottom wall 52 encloses an electric motor 54 and is mounted to the plenum base 16 by bolting or other methods known in the art. Elastomeric isolators 56 interposed between the motor chamber 30 and plenum base 16 reduce vibrations created by the pump mechanism 12 which otherwise would resonate in the plenum base 16. Air is drawn into the motor chamber through holes 64 in the motor chamber bottom wall.

The electric motor 54 includes heat generating components, such as a motor coil 58 and laminations 60, and magnetically oscillates a shuttle 62 back and forth. The shuttle 62 actuates the flexible diaphragms 44 that form part of the common sidewalls 42 of the motor chamber 30 to vary the volume of the adjacent pump assembly compression chambers 34. Actuation of the diaphragm 44 alternately increases and decreases the compression chamber 34 volume creating an air flow from the housing opening 15 through the chambers 30, 36, 34, and 32, into the plenum base 16, and out of the plenum port 20.

As the compression chamber 34 volume increases, air is drawn into the second chamber 36 through a passageway 48 from the motor chamber 30. A one-way flapper-type inlet valve 38 fixed to the compression chamber sidewall 40 permits the air 25 to be drawn into the compression chamber 34 from the chamber 36 when the volume of the chamber 34 is expanded. A one-way flapper-type exhaust valve 46 fixed on the wall 40 permits the passage of air 25 out of the compression chamber 34 into the adjacent first chamber 32 when the volume of compression chamber 34 is reduced. The air 25 exits the chamber 32 through a duct 18 that leads into the plenum base 16.

Referring to FIGS. 1 and 2, in use, the vacuum pump mechanism 12 draws air into the housing and through the motor chamber as the motor 54 actuates the opposing diaphragms 44. Actuating the diaphragms 44 causes the respective compression chambers 34 to alternately expand and contract. Drawing the air 25 through the motor chamber 30 and into the pump mechanism 14 creates a vacuum inside the housing such that cooling of the motor is performed by air at a lower density than possible.

SUMMARY OF THE INVENTION

The present invention is a vacuum pump with an improved cooling path. Air is drawn into a plenum base disposed below a pump mechanism. Ducts supply air directly from the plenum base to the pump mechanism. The pump mechanism exhausts the air and passes it over heat generating components prior to exhausting the air into the atmosphere. Thereby, a general objective of the present invention is accomplished by providing improved cooling for the pump motor in a vacuum pump by passing relatively higher density air through the motor chamber containing the pump motor.

DETAILED DESCRIPTION OF THE PREFERRED EMBODIMENTS

Figure 1:
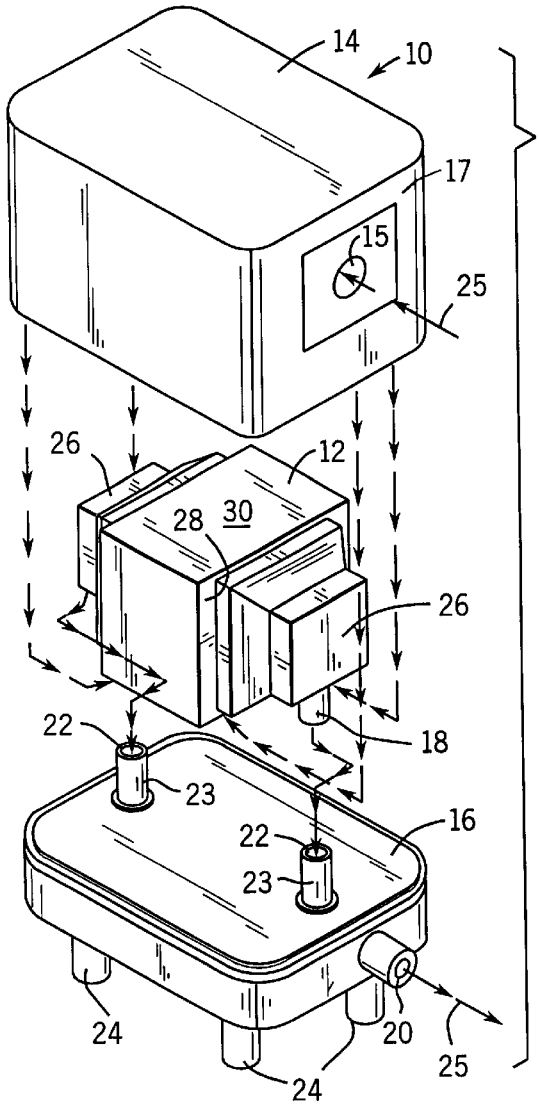
FIG. 1 PRIOR ART
FIG. 1 is an exploded perspective view of a prior art enclosed vacuum linear pump.
Figure 3:
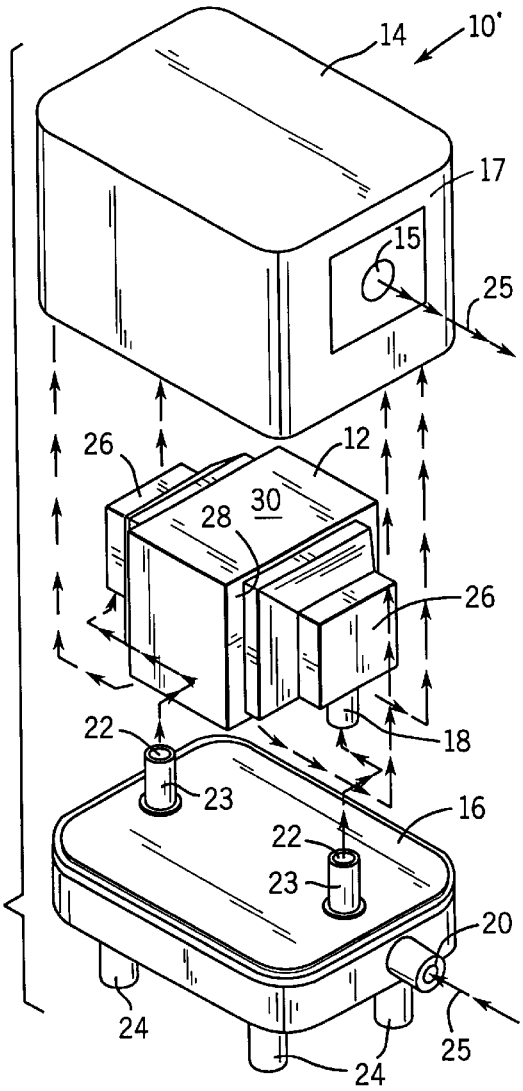
FIG. 3 is a view similar to FIG. 1, but of a pump incorporating the invention.
Figure 2:
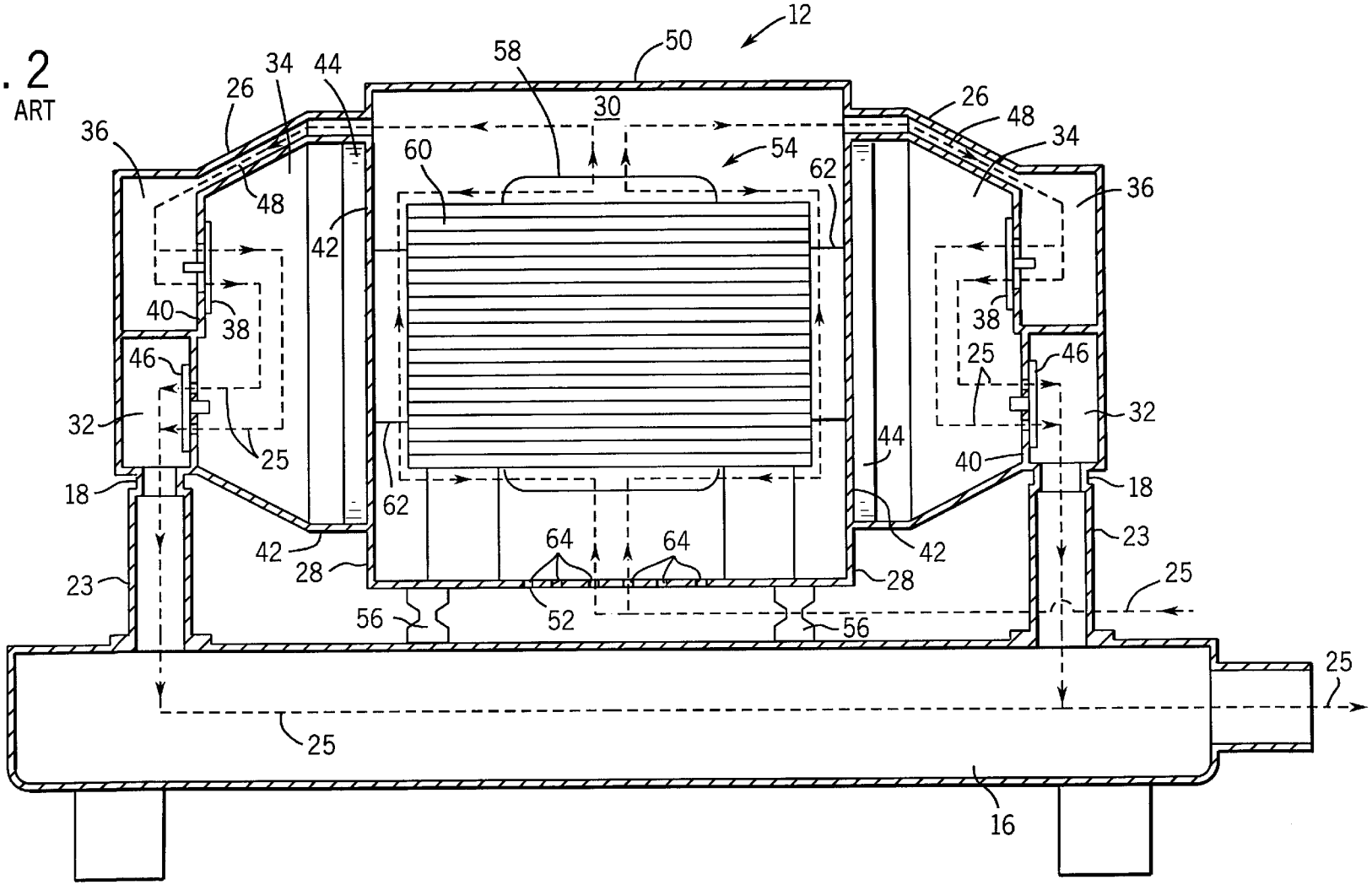
FIG. 2 PRIOR ART
FIG. 2 is a cross-sectional view of the pump of FIG. 1 with the housing removed.
Figure 4:
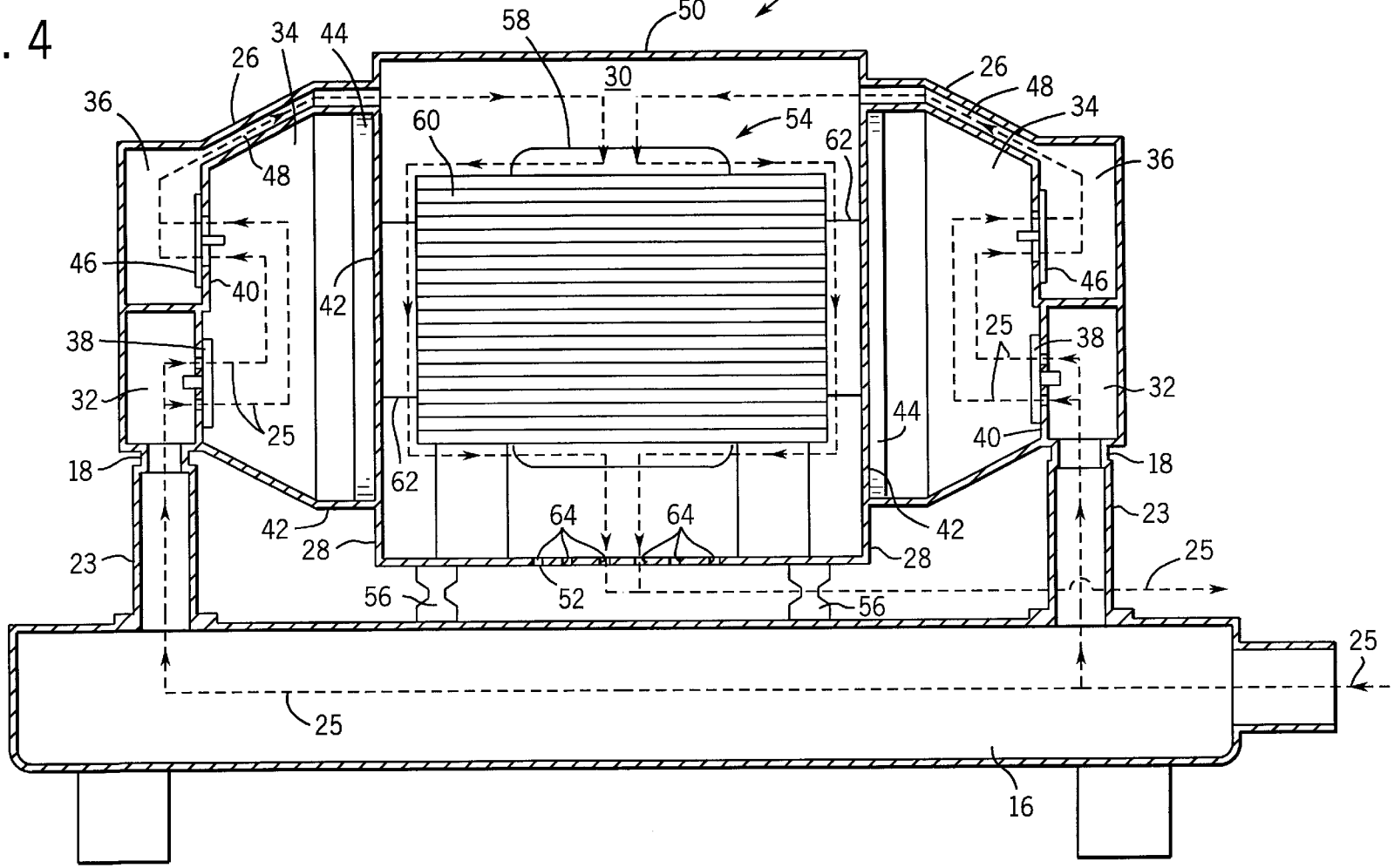
FIG. 4 is a view similar to FIG. 2, but of the pump of FIG. 3.

Referring to FIGS. 3 and 4, a preferred embodiment of a vacuum unit 10' incorporating the invention is illustrated. Corresponding elements of the unit 10' have been labeled with the same reference numbers as the unit 10. The unit 10' is the same as the unit 10, except that the direction of the valves 38 and 46 has been reversed. As a result, air flow through the unit 10' is reversed from the flow through the unit 10. This has the desirable effect of cooling the pump motor with relatively higher density air, for improved cooling of the motor.

More specifically, with the reversed arrangement of the valves 38 and 46, one-way flapper valve 38 fixed to compression chamber sidewall 40 permits the air 25 to be drawn into chamber 34 from the first chamber 32 when the compression chamber 34 expands. When the compression chamber 34 contracts, air is expelled from the compression chamber 34 into the second chamber 36 through the one-way flapper-type valve 46. From there, the air 25 exits through the passageway 48 and flows through the hollow motor chamber 30, in the spaces between the motor 54 and the motor chamber sidewalls 42, cooling the motor chamber 30 contents, such as the motor coil 58 and laminations 60, primarily by convection. The cooling air 25, which is at the outlet pressure of the pump and therefore the maximum density flowing through the pump unit 10' passes over and cools the motor 54 prior to exiting the motor chamber 30 into the housing 14 through holes 64 in the motor chamber bottom wall 52. Expelling the air 25 through the motor chamber 30 and into the housing 14 provides relatively dense air in these enclosures, thereby improving the cooling efficiency of the pump unit 10'.

The housing 14, having an air port 15, encloses the pump mechanism 12 and is mounted to the plenum base 16 by a snap fit, screws or the like. Because the air is exhausted into the housing a gasket interposed between the housing and base is not required to maintain an air tight seal. The port 15 formed in the housing wall 68 provides an escape into the atmosphere, a pipe, etc. for the air 25 exiting from the motor chamber 30.

While there has been shown and described what is at present considered a preferred embodiment of the invention, it will be apparent to those skilled in the art that various changes and modifications can be made therein without departing from the scope of the invention.

We claim:

1. In a vacuum pump of the type including a vacuum pump mechanism, said mechanism including a motor for driving said mechanism housed in a substantially enclosed motor chamber, a compression chamber which is expanded and contracted by operation of said motor, a first chamber, a one-way inlet valve for admitting one-way flow of a gas into said compression chamber from said first chamber, a second chamber and a one-way exhaust valve for exhausting compressed gas from said compression chamber into said second chamber, the improvement wherein said motor chamber has an inlet in communication with said second chamber through which said compressed gas from said second chamber flows into said motor chamber to cool said motor, and has an outlet through which said compressed gas from said second chamber is exhausted from said motor chamber, and further comprising a housing enclosing said motor chamber, wherein compressed gas from said motor chamber is exhausted into said housing so as to provide said gas in said motor chamber which is dense relative to the gas drawn into said first chamber, and wherein said housing has an exhaust port.

2. The improvement of claim 1, wherein said inlet to said motor chamber is positioned at one side of said motor chamber and said outlet from said motor chamber is positioned at an opposite side of said motor chamber.

3. The improvement of claim 2, wherein said vacuum pump includes an inlet plenum, said inlet plenum having an inlet port opening to the exterior of said housing, and wherein said first chamber of said vacuum pump mechanism is in communication with said inlet plenum.

4. A method for cooling a vacuum pump comprising the steps of:

drawing gas into a pump mechanism;

compressing said gas;

expelling said compressed gas from said pump mechanism into a motor chamber which houses a motor of said vacuum pump;

passing said compressed gas over heat generating components enclosed in said motor chamber;

expelling said gas out of said motor chamber into a housing which encloses said motor chamber to provide dense gas in said motor chamber relative to the gas drawn into said pump mechanism; and exhausting said gas from said housing.

5. A method as claimed in claim 4, wherein said steps including drawing gas into a plenum prior to drawing said gas into said pump mechanism.

* * * * *